United States Patent [19]

LeBrun

[11] 4,007,932

[45] Feb. 15, 1977

[54] MINIATURE HOCKEY GAME

[76] Inventor: Robert LeBrun, 2231 Augier St., Montreal, Quebec, Canada

[22] Filed: Feb. 26, 1976

[21] Appl. No.: 661,707

[52] U.S. Cl. ..... 273/85 F; 273/85 B

[51] Int. Cl.[2] ..... A63F 9/14

[58] Field of Search ..... 273/85 F, 85 B, 86 R, 273/85 A; 46/99, 106

[56] References Cited

UNITED STATES PATENTS

| | | | |
|---|---|---|---|
| 2,964,320 | 12/1960 | LeBrun | 273/85 A |
| 3,338,576 | 8/1967 | Andriulis | 273/85 F |
| 3,554,547 | 1/1971 | Vedeen et al. | 273/85 B |
| 3,672,674 | 6/1972 | Reed | 273/85 F |
| 3,693,291 | 9/1972 | Aoki | 273/86 R |
| 3,801,100 | 4/1974 | LeBrun | 273/85 F |

FOREIGN PATENTS OR APPLICATIONS

| | | | |
|---|---|---|---|
| 702,391 | 1/1965 | Canada | 273/85 B |

*Primary Examiner*—Anton O. Oechsle
*Assistant Examiner*—Harry G. Strappello
*Attorney, Agent, or Firm*—Raymond A. Robic; Arthur Schwartz

[57] ABSTRACT

A miniature hockey game comprising a substantially horizontal playing surface which moves in an orbital movement in the plane of the surface. Miniature playing members are unattachedly mounted on the playing surface to move over such surface as it is subjected to the orbital movement. Each member has a steering wheel normally in contact with the playing surface to direct its movement and it has a retractable friction disc normally out of contact with the playing surface. The friction disc is mounted on an elbowed shaft so that when it is applied against the surface, the playing member is stopped in its movement and starts to spin. The steering wheel and friction disc are interconnected so that when one touches the playing surface, the other is free from it. Control members are provided beneath the playing surface to cause application of the friction disc against the playing surface through magnetic action.

12 Claims, 13 Drawing Figures

Fig. 1
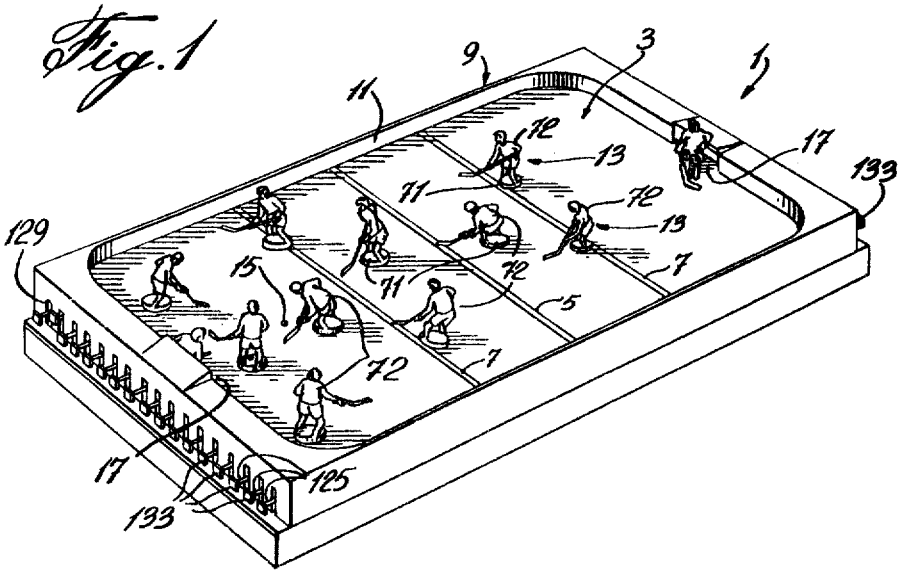
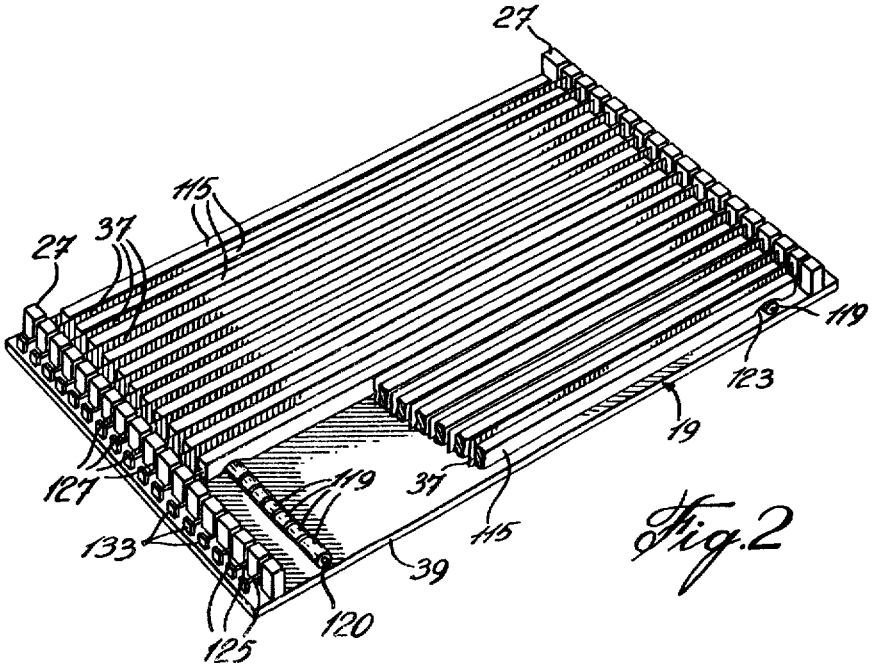
Fig. 2

MINIATURE HOCKEY GAME

The present invention is directed toward a game of the type having a playing surface; playing members on the surface; and means for moving the playing members about the surface.

A game of the above type can be used to simulate many sports, some of which, by way of example, are hockey, soccer, or basketball. The present invention will be described as simulating hockey, but it is understood that the other sports, described above, may be simulated as well.

Thus, the present invention provides a miniature hockey game having playing members on a playing surface, which members can be moved about the playing surface in a controlled fashion by the game players. The playing members are divided into the teams, and can be controlled to simulate carrying, chasing, passing or shooting a puck. In addition, the playing members can simulate body checking.

The miniature hockey game of the present invention provides more approximate simulation of hockey than known games. The playing members are free to move about the entire playing surface, and more than one playing member can be controlled by a player at a time. Further each playing member can be played by a separate player.

More specifically, the miniature hockey game according to the invention comprises a substantially horizontal playing surface and means imparting to this surface an orbital movement in its plane; a plurality of miniature playing members unattachedly mounted over the playing surface to move thereover as the surface is subjected to the orbital movement. Each playing member includes steering means having a steering wheel and intended to ensure movement of the playing member in substantially one direction; eccentric pivot means applicable against the playing surface to stop movement of the member in the said direction and to cause spinning thereof; coupling means joining the eccentric pivot means and the steering wheel to change the direction of the steering wheel as the playing member spins, upon application of the pivot means on the surface; resilient means acting on the steering wheel and on the pivot means to bias the steering wheel against the playing surface and to bias the pivot means away from the playing surface. Control means are provided beneath the playing surface, such control means being operable from either end thereof selectively to cause application of the eccentric pivot means against the surface to allow reorientation of the steering wheel.

In a preferred embodiment of the invention, the surface is made of non-magnetic material and the eccentric pivot means comprises a magnetic disc mounted for rotation at one end of an elbowed shaft, this shaft being rotatably mounted vertically on the playing member.

According to a further embodiment, the steering means also comprises a vertical axle on which the steering wheel is fixedly mounted, the coupling means comprising a pulley on the shaft and a pulley on the steering wheel axle with a belt interconnecting the pulleys to ensure simultaneous rotation when the elbowed shaft spins. A rocking lever is provided which has its ends connected to the shaft and to the axle respectively, the shaft and the axle being mounted for limited vertical sliding displacement whereby as the disc is brought down against the playing surface by the control means, the steering wheel is lifted therefrom and made free to spin.

In these preferred embodiments, the steering means further comprises a pair a pair of lateral wheels on either side of the steering wheel, means mounting the lateral wheels for rotation only about a common axis transverse to the playing member, these lateral wheels being mounted on pins for sliding displacement therealong and resilient means on either side of each lateral wheel to bias the lateral wheels toward a central position.

An embodiment of the present invention, with variants, will now be described in detail having reference to the accompanying drawings in which:

FIG. 1 is a schematic view of a miniature hockey game according to the invention;

FIG. 2 is a schematic view of the game with the playing surface removed;

Figure 3:
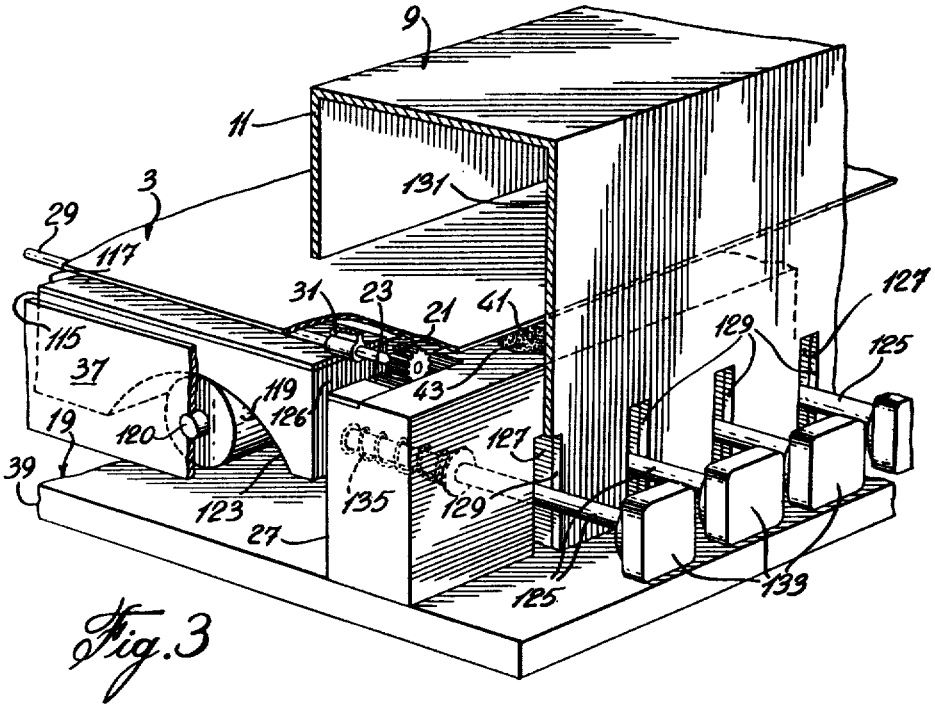
FIG. 3 is a schematic view, in partial cross-section, showing details of the controls and the mounting of the playing surface.
Figure 4:
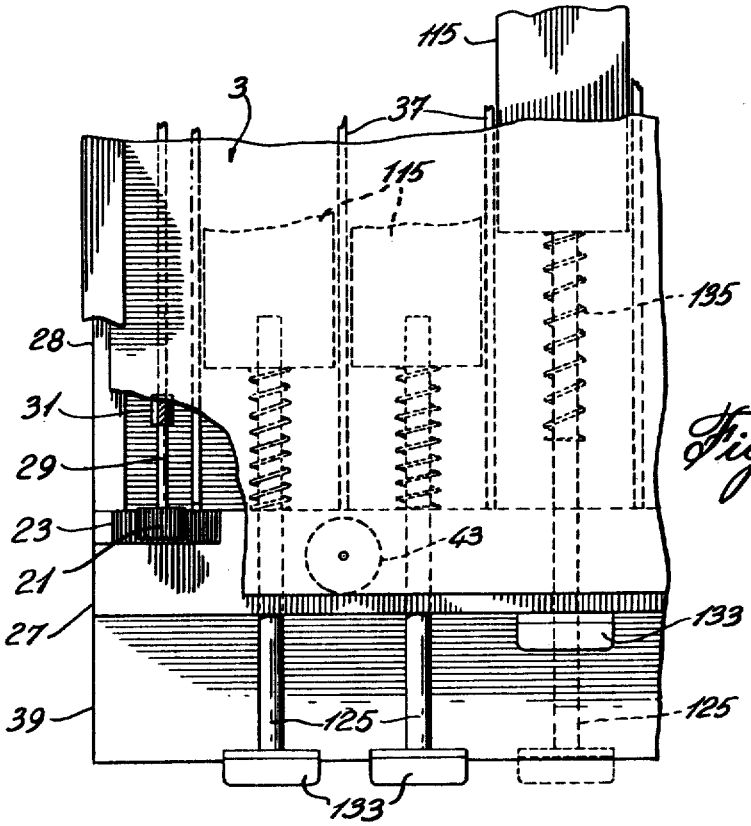
FIG. 4 is a plan view, in partial cross-section, showing details of the controls and the mounting of the playing surface.
Figure 5:
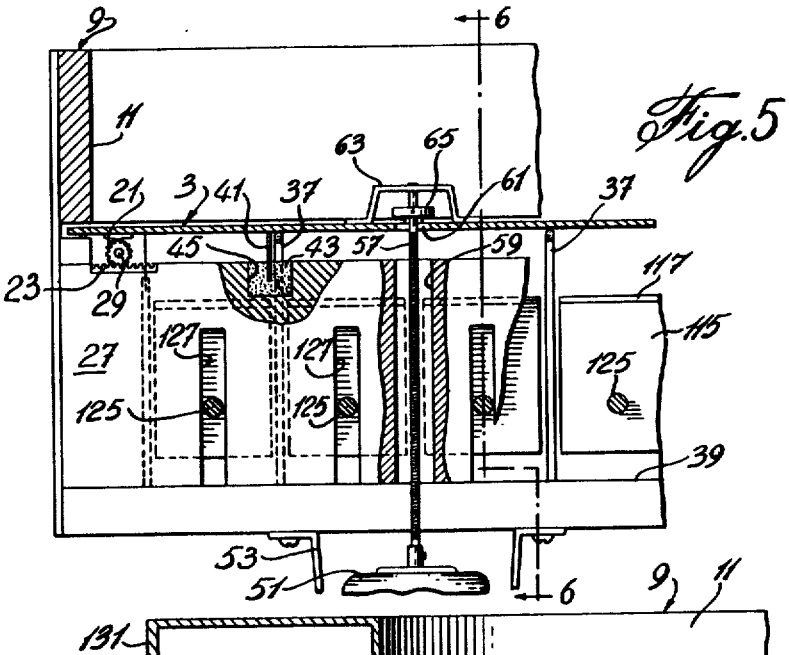
FIG. 5 is a cross-sectional elevation view, showing details of the controls and the mounting of the playing surface.
Figure 13:
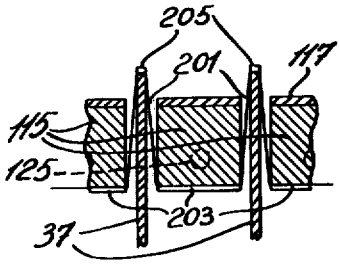

FIG. 13 appearing on the same sheet as FIG. 5 show an alternate means for moving the strips of magnetic material.

The miniature hockey game 1, as shown in FIG. 1, includes a sheet of non-magnetic material providing a playing surface 3 marked as a hockey rink having a red line 5 and blue lines 7. The playing surface 3 is enclosed about its edge by a casing 9. The casing 9 forms a barrier or wall 11 for keeping the playing members 13 and the playing object, in this case, a puck 15, on the playing surface. The casing 9 is provided at each end of the playing surface with goals 17.

The playing members 13 are grouped into two teams and means are provided for moving the members of both teams about the playing surface with, or in pursuit of, the puck, in attempts to put the puck in either goal to score. In order to move the playing members about the playing surface 3, the surface is mounted on a frame 19 in such a manner that can be moved cyclically, in a closed path within a substantially horizontal plane. As shown in FIGS. 3 to 6, the playing surface 3 is mounted on frame 19 at each corner of the surface by a gear wheel 21. Each gear wheel 21 runs on a short section of gear track 23 mounted on the corner of an end support 27 of the frame. The track 23 is substantially parallel to support 27. Each gear wheel 21 is connected to a shaft 29 which slidably passes through a bracket 31 suspended from the bottom of the playing surface 3 near the corner of the playing surface. The shaft 29 on each side of the playing surface can extend between the two corners on each side of the surface. The shaft 29 can thus join gear wheels 21 at two corners. With the surface 3 slidably mounted on the shafts 29 by brackets 31 to move in a longitudinal direction, and simultaneously movable laterally along tracks 23, the surface 3 thus is mounted to move in any direction in a substantially horizontal plane.

The surface 3 is supported by support means comprising supports pegs 41 and longitudinal plates 37. Support pegs 41 are located adjacent each corner by an upper surface of a support peg 41, the lower end of each peg 41 being embedded in a soft rubber plug 43. Plugs 43 are rigidly mounted in four bores 45, two of which are situated adjacent opposite ends of end support 27.

In addition, longitudinal plates 37 extend beneath the playing surface 3 and along the length thereof, opposite ends of the plates terminating at the end supports 27. Each longitudinal plate 37 includes upstanding protuberances 37*a* having low friction upper surfaces on which the portion of the playing surface intermediate the ends thereof rests. Alternatively, the plates 37 can be of wider construction than shown in the drawings and include upstanding friction points along their length, the upper surfaces of which support the playing surface while exhibiting a low coefficient of friction between themselves and the bottom of the playing surface.

Figure 6:
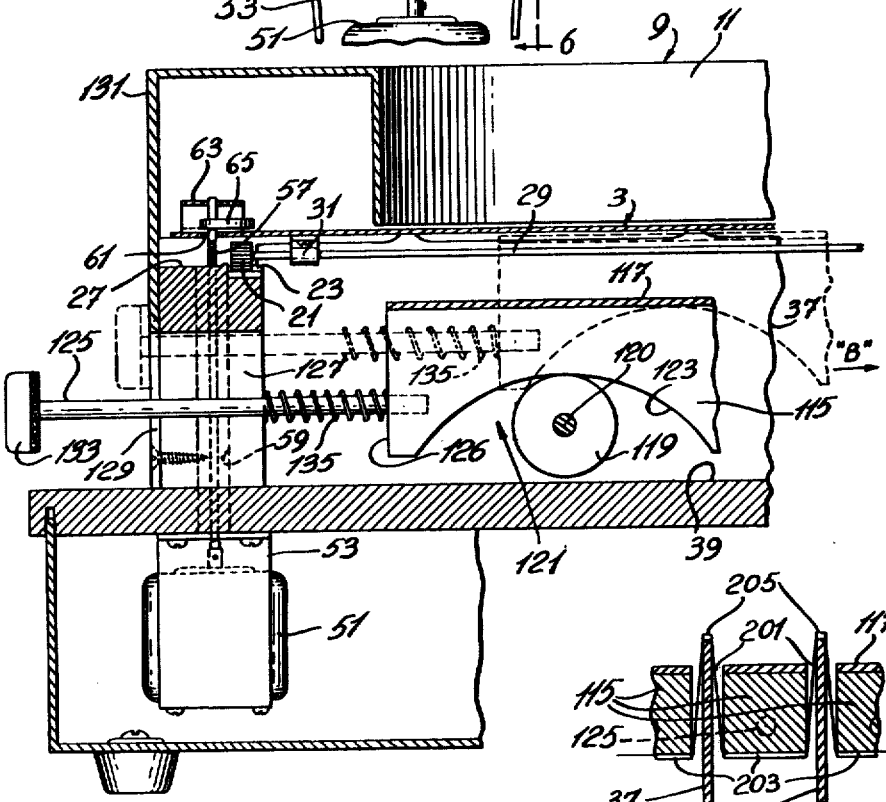
FIG. 6 is a cross-sectional view taken along line 6—6 of FIG. 5.

Suitable means are provided for cyclically moving the support surface 3 in a closed path, such as a circle, in a horizontal plane. In one embodiment as shown in FIGS. 5 and 6, these cyclic moving means can comprise a motor 51 supported by a bracket 53 beneath the base 39 of frame 19. The motor 51 is connected to drive a flexible shaft 57 which extends up through a bore 59 in one frame end support 27. The shaft 57 extends through an enlarged hole 61 in playing surface 3 and passes through a hole in a bracket 63 covering hole 61 and attached to the top of playing surface 3. A weight in the form of a circular disc 65 is eccentrically fixed to shaft 57 beneath bracket 63.

In operation, motor 51 is normally continually operated, actuated by suitable switch means, (not shown) on the frame. The motor 51 rotates shaft 57 and thus eccentric disc 65. Rotation of eccentric disc 65 causes playing surface 3, through its connection to shaft 57 by bracket 63, to cyclically follow a circular or orbital path as shown by arrows "A" in FIGS. 9 and 10. The corner mountings employing gears 21 and tracks 23, support pegs 41 and flexible shaft 57 permit the surface 3 to carry out this cyclic, rotary movement while still being supported and cyclically driven by motor 51.

Each playing member 13, as shown in FIGS. 7 to 10, is adapted to move along surface 3, as surface 3 is cycled through a circular path. Each playing member 13 includes a base casing 71 upon which a playing FIG. 72 (FIG. 1) is mounted. A pair of rotatable side wheels 73 having low friction rolling surfaces and made of steel, brass, or fiberglass are mounted by suitable brackets 74 on the sides 75 of casing 71. Side wheels 73 are supported on horizontal axles and two springs 73*a* are mounted on each axle, one on either side of wheel 73 between the wheel and the sides of the brackets 74. Springs 73*a* absorb side movements of the playing surface 3 without causing the side movement of the playing member 13. A pivotable, rotatable trailing wheel 77 having a low friction rolling surface is mounted adjacent the back wall 78 of casing 71. Wheel 77 is supported in an offset, trailer manner by a bracket 79 which is attached to casing 71 to pivot about a vertical pin 81. The back and forth movement of the wheel 77 does not affect the overall movement of the playing member due to the playing member's inertia, but rather only provides vertical support for the playing member.

A steering wheel 83 is provided adjacent front wall 84 of casing 71. The steering wheel 83 is mounted to be freely rotatable by an axle 85 in a housing 87 which in turn is rotatably mounted to a mounting plate 88 within casing 71, by a vertical shaft 89. Mounting plate 88 is spaced below top wall 90 of the casing 71 and mounts brackets 74 and axle 85 as well. Steering wheel 83 carries a concentric ratchet wheel 91. A pawl 93 is mounted by an axle 95 in housing 87. Pawl 93 cooperates with ratchet wheel 91 to limit free rotational movement of steering wheel 83 in one direction as is well known. Space is left between steering wheel 83 and ratchet wheel 91 in order to provide clearance for pawl 93 to slide along the width of the ratchet wheel 91, the wheel 83 being so mounted and provided with springs 83*a* as to compensate for lateral play without resulting in sideways movement of the playing member 13. Steering wheel 83 is of rubber construction and has an adherent outer surface to increase the coefficient of friction between the wheel 83 and surface 3.

During operation of the game, as the support surface 3 is moved cyclically through a closed circular path, each playing member 3 is moved in the direction faced by its steering wheel 83. The playing members 13 move in this direction since they are carried by freely rotatable wheels. Each playing member is restricted from movement in the opposite direction since the ratchet wheel 91 and pawl 93 permit movement in the one direction only. Reverse movement of the playing member is only permitted when the steering wheel 83 is rotated through an angle of 180° relative to its alignment for straight ahead movement. Further, the playing member 13 is restricted from moving sideways by use of springs 73*a* in association with side wheels 73 and the inertia of the playing member itself.

Figure 7:
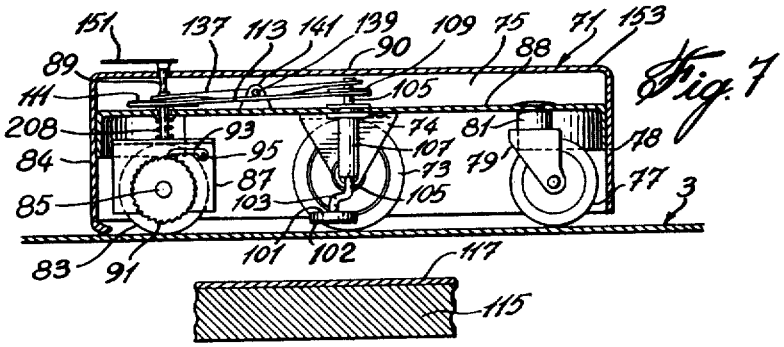
FIG. 7 is a cross-sectional view of a playing member.
Figure 8:
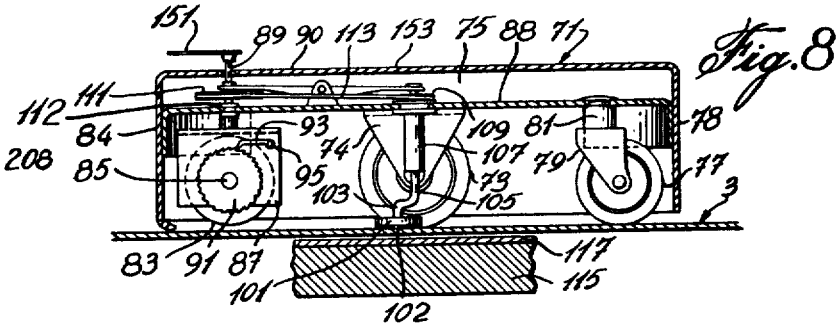
FIG. 8 is a cross-sectional view of a playing member showing operation of its steering mechanism.
Figure 9:
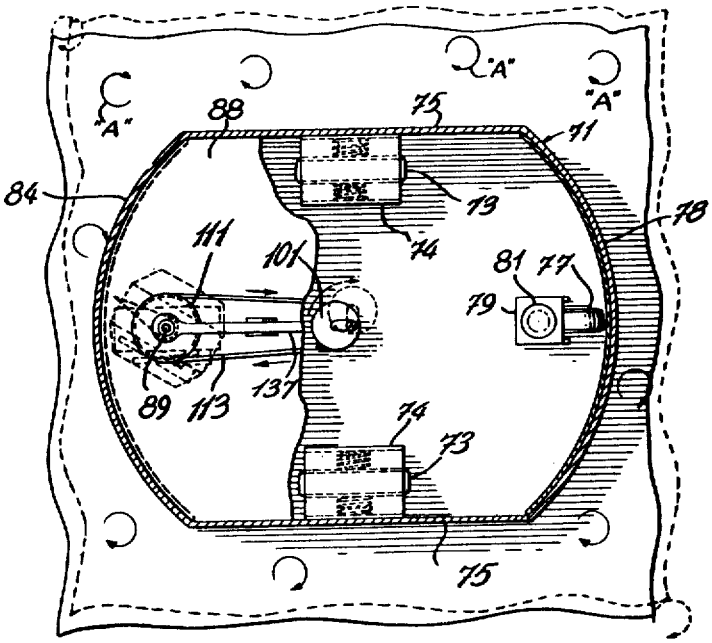
FIG. 9 is a plan view, in partial cross-section, of a playing member showing operation of its steering mechanism.
Figure 10:
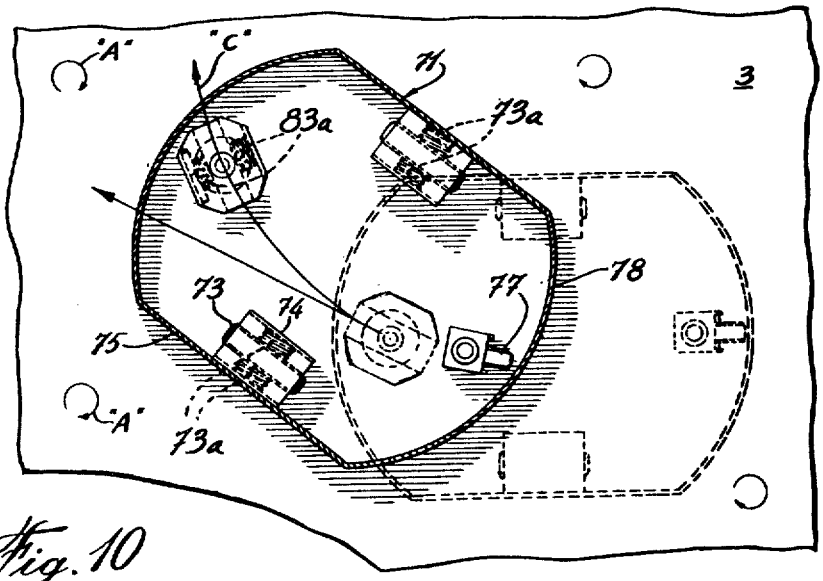
FIG. 10 is a plan view showing movement of a playing member.

Means are provided for controlling the direction of movement of playing members 13 so that they can be controlled to move toward the puck, or with the puck toward a goal. To this end, each member 13 is provided with a magnet 101 having a rubber covering 102 and being rotatably mounted on an offset arm 103 of a vertical shaft 105 as shown in FIGS. 7 to 9, such that the magnet 101 is free to turn on arm 103. Shaft 105 is rotatably mounted in a sleeve 107 centrally suspended from mounting plate 88 in casing 71. The shaft 105 projects above mounting plate 88. Fixed to this projecting end of shaft 105 is a pulley 109.

Shaft 89, of drive wheel 83 projects above mounting plate 88 also. A pulley 111 is fixed to the projecting portion of shaft 89. A belt 113 connects pulleys 111 and 109. It will be seen that as shaft 105 is rotated, shaft 89 will also rotate through the belt 113 and pulleys 11 and 109. Due to the inertia of the playing member 13, it is not rotated due to rotation of shaft 105. The amount of rotation of shaft 89 determines the direction taken by wheel 83 and thus the direction followed by member 13.

In order to rotate shaft 105, magnetic means are provided beneath surface 3. These magnetic means, as shown in FIGS. 3 to 6, comprise a plurality of elongate strip blocks 115 extending longitudinally of the frame 19 between end supports 27. The blocks 115 are closely adjacent one another and carry a strip 117 of magnetic material on their top surface. Normally the blocks 115, and thus the magnetic material strips 117, are located some distance below playing surface 3 and thus do not attract magnets 101 on members 13. Means are provided for selectively moving the blocks 115 toward playing surface 3. In one embodiment, the blocks 115 are mounted on rollers 119 at each end adjacent end supports 27. The rollers 119 are rotatable on a shaft 120 which can be supported either on base 39 or between side walls 28 of the frame. A large concave depression 121 is formed in the bottom of each block 115 providing a curved concave surface 123 through which each block, near each end, is supported on a roller 119. A handle 125 is provided at each end 127 of each block 115. The handles 125 project out through vertical slots 127 in end supports 27 and aligned vertical slots 129 in the end walls 131 of casing 9. Control knobs 133 are attached to the ends of handles 125. A spring 135 is mounted on each handle 125 between blocks 115 and frame end supports 27.

Shaft 105, carrying magnet 101, is mounted for vertical movement in sleeve 107. As magnet 101 moves down, drive wheel 83 is simultaneously raised through a rocking lever 137, as shown in FIGS. 7 and 8 mounted by a hinge pin 139 on a bracket 141 on mounting plate 88. The rocking lever 137 is connected at its ends to shafts 105 and 89 by suitable means. Further, a coil spring 208 is mounted on shaft 89 between the upper surface of housing 87 and the lower surface of top wall 153, thereby biasing steering wheel 83 into contact with surface 3. When spring 208 is extended, pulley 11 is brought into contact with a flanged collar 112 in which shaft 89 is freely rotatable and which is rigidly secured in an opening in the top wall 153, as best seen in FIG. 8. Engagement between flanged collar 112 and pulley 111 prevents rotation of the latter. Only when block 115 and strip 117 are actuated is the pulley pivoted by lever 137 out of contact with collar 112 and is thereby free to rotate to change the direction of steering wheel mechanism.

In operation, to change the direction of movement of one of the playing members 13, the block 115 directly under, or closest to magnet 101 of the member 13 is raised. The block 115 is raised by the player, at the one end, who controls the player member, pushing the knob 133 associated with the block 115. When the knob 133 is pushed in, block 115 is moved to the right as shown by arrow "B" in FIG. 6 and the block rises toward playing surface 3 as its curved surfaces 123 move over the rollers 119. The surfaces 123 are, in effect, cam surfaces. The block 115 rises to place the strip 117 of magnetic material adjacent playing surface 3 as shown in dotted lines in FIG. 6. Magnet 101 is then attracted to strip 117 and moves downwardly until its rubber covering 102 contacts surface 3 as shown in FIG. 8, while raising driving wheel 83 through rocking lever 137. Frictional contact of the covering 102 with surface 3 results in rotational movement of offset arm 103 and shaft 105 and magnet 101 turns freely on shaft 103 as the surface 3 rotates or oscillates. At the same time playing members 13 do not follow the rotation of shaft 105 due to their own inertia, as pointed out previously. In this way, magnet 101 and the rotation of shaft 105 only change the direction to be travelled by the playing member 13 but do not have any effect on the movement thereof over surface 3. A directional pointer 151 is attached to shaft 89 which projects through the top wall 153 of casing 71. Pointer 151 turns as shaft 89 rotates. When the pointer 151 finally points in the direction it is desired to have the player move, raised block 115 is then immediately lowered by releasing knob 133. Spring 135 moves the block 115 over rollers 119 to a lowered rest position. Steering wheel 83 now pointing in the desired direction, drops down, lifting magnet 101 up through rocking lever 137. The playing member 13 will now follow a forward curved path as shown by arrow "C" in FIG. 10 until steering wheel 83 is straightened. At 90° left or right position of steering wheel 83, member 13 will make a fast spin.

It is thus seen that each playing member 13 can be controlled from each end of the playing surface by exposed knobs 133. All the playing members will be constantly moving as the playing surface cycles in the direction they are pointed by their steering wheel. The direction however can be readily controlled. The game readily simulates the game of hockey. The puck can be carried by a player, or shot or passed as the player is rotated. Body checking is also simulated. If desired, to avoid conflict, the blocks 115 can be so arranged, that every second block is controlled only from one end of the playing surface, while every other block is controlled only from the other end of the playing surface.

Figure 11:
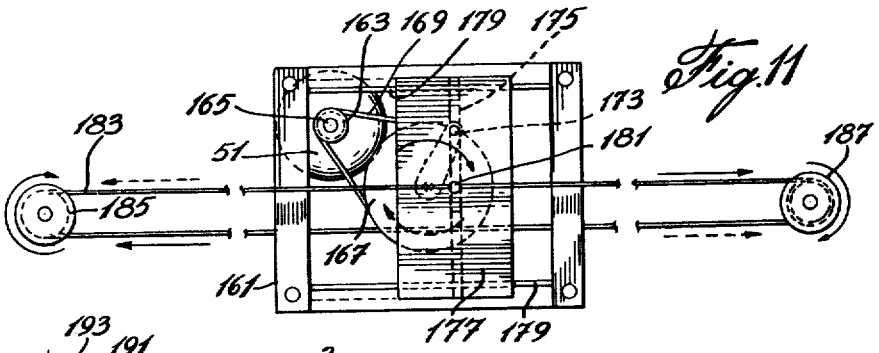
FIG. 11 is a plan view of an alternate for moving the playing surface of the game.
Figure 12:
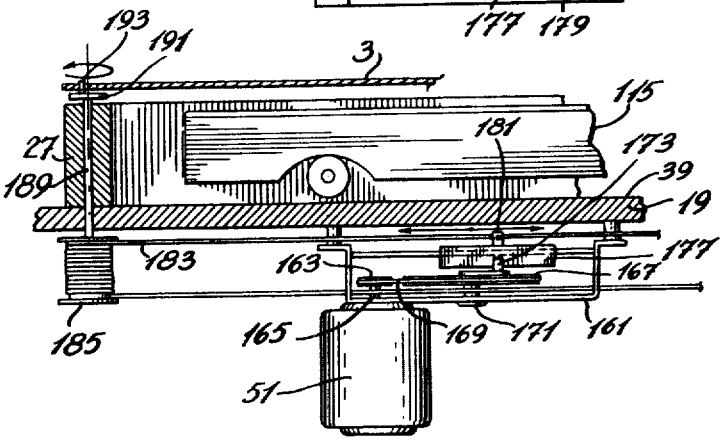
FIG. 12 is an elevation view of the alternate means shown in FIG. 11.

The game has been described with the playing surface rotated continually in one direction only during operation. If desired however, mechanism can be provided for intermittently changing the direction of rotation of the playing surface during operation. This gives an added dimension to the game. As shown in FIGS. 11 and 12, the motor 51 can be connected to the base 39 of frame 19 by a bracket 161. A pulley 163 is mounted on the drive shaft 165 of motor 51. Pulley 163 is connected to pulley 167 by belt 169. Pulley 167 is mounted by an axle 171 on bracket 161. Pulley 167 carries a pin 173 which fits in a straight groove 175 in a sliding block 177. Block 177 slides on rods 179 mounted on bracket 161. A pin 181 on the top of block 177 is attached to a cord 183. Cord 183 is wound about two spaced apart spools 185, 187 between which bracket 161 is located. The spools 185, 187 are supported from base 39. One spool 185, has a shaft 189 fixed to it which shaft extends through a hole in a frame end member 27. A disc 191 is fixed to the top of the shaft 189 just beneath playing surface 3. Disc 191 carries an eccentric pin 193 which projects through a hole in surface 3.

In operation, as the motor 51 is operated, pin 173 moves block 177 first in one direction, then the other. As the block 177 moves in each direction, cord 183 revolves the spools 185, 187 first in one direction for a certain number of revolutions, and then in an opposite direction. As the spools 185 and 187 rotate, they rotate playing surface 3 via eccentric pin 193 first in one direction, for a certain number of revolutions, and then in the opposite direction. In addition to intermittently changing the direction of rotation of the playing surface, the speed of revolution in either direction varies as well.

FIG. 13 illustrates another manner for moving blocks 115, and thus the strip 117 of magnetic material on top of each block, toward the playing surface 3. Instead of mounting the blocks 115 on rollers 119, each block 115 can be suspended, for example at each end between the longitudinal plates 37 by cord 201, or at spaced points along the length thereof. A groove 203 is provided in the bottom of each block 115 at each end for receiving cord 201. The ends of the cord 201 pass up and over notches 205 in adjacent plates 37. The blocks 115 are thus rockingly suspended from the plates 37. Pushing in on handle 125 will cause the block to swing up in a pendulum manner, thereby moving strip 117 adjacent surface 3.

I claim:

1. Miniature hockey game comprising:

a substantially horizontal playing surface and means imparting to said surface an orbital movement in the plane of said surface;

a plurality of miniature playing members unattachedly mounted over said playing surface to move thereover as said playing surface is subjected to said orbital movement, each member including:

steering means having a steering wheel, said steering means ensuring movement of said playing member in substantially one direction, eccentric pivot means applicable against said surface to stop movement of said playing member in said one direction to permit spinning thereof, coupling means joining said eccentric pivot means and said steering wheel to change the direction of said steering wheel as said member spins upon application of said pivot means on said surface, resilient means acting on said steering wheel and on said pivot means to bias said steering wheel toward said playing surface and to bias said pivot means away from said playing surface, and control means beneath said playing surface, operable from either end thereof, selectively to cause application of said eccentric pivot means against said surface to allow reorientation of said steering wheel.

2. Miniature hockey game as claimed in claim 1, wherein said surface is made of non-magnetic material and said eccentric pivot means comprises a magnetic disc mounted for rotation at one end of an elbowed shaft and means rotatably mounting said elbowed shaft vertically on said playing member.

3. Miniature hockey game as claimed in claim 2, wherein said magnetic disc is lined, on the side thereof facing said playing surface, with slip-preventing material.

4. Miniature hockey game as claimed in claim 2, wherein said steering means further comprises:

a vertical axle and means fixedly mounting said steering wheel on said vertical axle for rotation in unison and wherein said coupling means comprises:

a pulley on said shaft and a pulley on said steering wheel axle, a belt interconnecting said pulleys to ensure simultaneous rotation when said elbowed shaft spins;

a rocking lever having its ends respectively connected to said elbowed shaft and to said steering wheel axle and wherein said elbowed shaft and steering wheel axle are mounted for limited vertical sliding displacement whereby as said disc is brought down against said playing surface by said control means, said steering wheel is lifted therefrom and made free to spin.

5. Miniature hockey game as claimed in claim 4, wherein said resilient means is a spring acting on said vertically displaceable steering wheel axle to bias it toward said playing surface.

6. Miniature hockey game as claimed in claim 4, wherein said steering means further comprises a pair of lateral wheels on either side of said steering wheel, means mounting said lateral wheels for rotation about a common axis transverse to said playing member, said lateral wheels being mounted on pins for limited sliding displacement therealong and resilient means on either side of each lateral wheel to bias said lateral wheels toward a central position.

7. Miniature hockey game as claimed in claim 4, wherein said control means comprises:

a plurality of parallel elongated operating blocks mounted for axial displacement beneath said playing surface and having a strip of magnetic material along the top edge thereof;

handle means on at least one end of each of said blocks manually operable to cause said axial displacement, and means to lift said blocks toward said playing surface when in said orbital movement, whereby upon the magnetic disc of a playing member being located along one of said blocks, lifting of the said one block by the said lifting means causes said magnetic disc to be applied against said playing surface thereby permitting said playing member and said steering wheel to spin.

8. Miniature hockey game as claimed in claim 4, wherein said orbital movement imparting means comprises:

a motor and a flexible shaft mounted at one end for rotation therewith;

a bracket fixed to said playing surface and means securing the other end of said flexible shaft to said bracket, and a disc eccentrically mounted on said flexible shaft adjacent said other end whereby an orbital movement is applied to said playing surface as said motor and said shaft rotate.

9. Miniature hockey game as claimed in claim 4, wherein said orbital movement imparting means comprises:

a motor;

a pair of spools and a cord wound respectively on said spools;

connecting means joining said cord and said motor to allow movement of said cord alternately in opposite directions thereby causing rotation of said spools alternately in opposite directions;

a shaft fixedly mounted on one of said spools axially along the axis of rotation of said one of said spools;

a disc at one end of said shaft and an eccentric pin projecting from said disc, and wherein said playing surface has a hole therethrough through which said pin extends.

10. Miniature hockey game as claimed in claim 4, wherein said control means comprises:

a plurality of parallel elongated operating blocks mounted for axial displacement beneath said playing surface and having a strip of magnetic material along the top edge thereof;

handle means on at least one end of each of said blocks manually operable to cause said axial displacement;

means to lift said blocks toward said playing surface when in said orbital movement, whereby upon the magnetic disc of a playing member being located along one of said blocks, lifting of the said one block by the said lifting means causes said magnetic disc to be applied against said playing surface thereby permitting said playing member and said steering wheel to spin;

a motor and a flexible shaft mounted at one end for rotation therewith;

a bracket fixed to said playing surface and means securing the other end of said flexible shaft to said bracket, and a disc eccentrically mounted on said flexible shaft adjacent said other end whereby an orbital movement is applied to said playing surface as said motor and said shaft rotate.

11. Miniature hockey game as claimed in claim 4, wherein said control means comprises:

a plurality of parallel elongated operating blocks mounted for axial displacement beneath said playing surface and having a strip of magnetic material along the top edge thereof;

handle means on at least one end of each of said blocks manually operable to cause said axial displacement;

means to lift said blocks toward said playing surface when in said orbital movement, whereby upon the magnetic disc of a playing member being located along one of said blocks, lifting of the said one block by the said lifting means causes said magnetic disc to be applied against said playing surface thereby permitting said playing member and said steering wheel to spin;

a motor;

a pair of spools and a cord wound respectively on said spools;

connecting means joining said cord and said motor to allow movement of said cord alternately in opposite directions thereby causing rotation of said spools alternately in opposite directions;

a shaft fixedly mounted on one of said spools axially along the axis of rotation of said one of said spools;

a disc at one end of said shaft and an eccentric pin projecting from said disc, and wherein said playing surface has a hole therethrough through which said pin extends.

12. Miniature hockey game as claimed in claim 4, wherein said orbital movement imparting means comprises:

a pair of axles extending longitudinally along and beneath said playing surface;

a frame having upstanding ends extending transversely of said axles and having track segments thereon;

pinions fixedly mounted at the ends of said axles and meshing with said segments, and brackets fixed beneath said playing surface and through which said axles freely extend to support said playing surface.

* * * * *